United States Patent [19]

Exbrayat et al.

[11] 4,207,729

[45] Jun. 17, 1980

[54] METHOD AND APPARATUS FOR COATING TEXTILE STRANDS OR THREADS FOR USE IN HOISERY OR WEAVING

[75] Inventors: Pierre E. Exbrayat; Richard A. Schutz, both of Mulhouse, France

[73] Assignees: Institut Textile de France; Agence Nationale de Valorisation de la Recherche (A.N.V.A.R.), both of RX

[21] Appl. No.: 690,020

[22] Filed: May 26, 1976

[30] Foreign Application Priority Data

May 27, 1975 [FR] France ..... 75 16503

[51] Int. Cl.[2] ..... D01H 13/30

[52] U.S. Cl. ..... 57/296; 57/297; 57/328

[58] Field of Search ..... 57/35, 36, 77.3, 77.45, 57/157 TS, 157 R, 164, 296, 297, 328

[56] References Cited

U.S. PATENT DOCUMENTS

| | | | |
|---|---|---|---|
| 2,340,051 | 1/1944 | Goodings et al. | 57/164 X |
| 2,515,299 | 7/1950 | Foster et al. | 57/77.3 |
| 2,946,181 | 7/1960 | Tissot et al. | 57/157 TS |
| 3,287,888 | 11/1966 | Chidgey | 57/35 |
| 3,512,232 | 5/1970 | Bolinger | 57/164 X |
| 3,548,462 | 12/1970 | Naegeli | 57/164 X |
| 3,559,392 | 2/1971 | Crouzet | 57/77.3 |
| 3,802,174 | 4/1974 | Landwehrkamp et al. | 57/35 X |
| 3,877,214 | 4/1975 | Vander Werf | 57/35 X |
| 3,945,186 | 3/1976 | Van Dort | 57/164 X |
| 4,007,580 | 2/1977 | Nijhuis | 57/164 X |

*Primary Examiner*—John Petrakes

[57] ABSTRACT

Textile strands or threads with no twist at least partially coated by wax are formed by immersion in a molten wax while in a false twisted state. The coated strands or threads are then cooled and the wax solidifies.

10 Claims, 7 Drawing Figures

METHOD AND APPARATUS FOR COATING TEXTILE STRANDS OR THREADS FOR USE IN HOISERY OR WEAVING

BACKGROUND OF THE INVENTION

1. Field of the Invention

The present invention relates to a method of and an installation for producing textile strands or threads to be used in knitting or weaving.

2. Description of the Prior Art

To give the fibres of textile threads better mutual adherence so that the said threads are better adapted to withstand the various stresses to which they are subjected during knitting or weaving operations, it is known to twist bundles of fibres to a sufficient extent and to prepare them by applying to them a glue in aqueous solution. In order to eliminate the spinning operation of the strands, i.e. the twisting proper, it has already been suggested to size the various hackled slivers or spindle frame strands while subjecting the fibres of the latter neither to additional drawing nor to excessive twisting. However, the threads glued in aqueous solution require a considerable drying time, requiring drying devices which are the more cumbersome the higher the speed of displacement of the threads. It is also seen that the power necessary for drying glued threads increases with the dimensions of the drier and the speed of movement of the threads within the said drier. Furthermore, the maximum speed of movement of threads having practically parallel or little twisted fibres is relatively limited by low mutual cohesion of the fibres.

SUMMARY

The present invention aims to eliminate the above mentioned drawbacks and to provide a method of and an installation for producing textile strands or threads which are formed by short fibres, practically with no twisting, and designed to be used in hosiery or in the production of high speed threads without requiring a cumbersome installation.

This aim is attained by the method in that, according to the invention, the strands or threads having practically parallel fibres are first subjected to false twisting, and then coated, in the false twisting state, at least at regular intervals, by a wax in a molten state, and then the thread-wax assembly is cooled in still air or in a current of cooling gas.

Owing to these various steps, the threads can be drawn along at increased speed before being coated with wax. Practically instantaneous cooling due to the wax gives the threads thus treated considerable tensile strength, while the false twisting temporarily used for obtaining improved adherence between the fibres of the threads is eliminated. By employing a wax whose application temperature is kept a few degrees above its melting point, solidification of the wax takes place rapidly a short time after the latter is placed in contact with the threads and, at most, a few seconds afterwards in the ambient atmosphere.

The installation for producing the strands or threads substantially with no twisting, the said strands or threads being designed to be used in hosiery articles and/or fabrics, comprises, according to the invention, a bobbin or a can for storing textile slivers, strands or threads, a means for applying wax to the textile thread, a false twisting device, a cooling zone, a pair of tension rollers, and a device for winding up the treated thread.

With such an installation, the production speed of threads may be considerably higher than 100 and even 150 m/min and the dimensions, particularly the length of the installation, can be substantially reduced. In particular, the length of the cooling zone need not exceed 1 meter.

DESCRIPTION OF THE PREFERRED EMBODIMENTS

Figure 1:
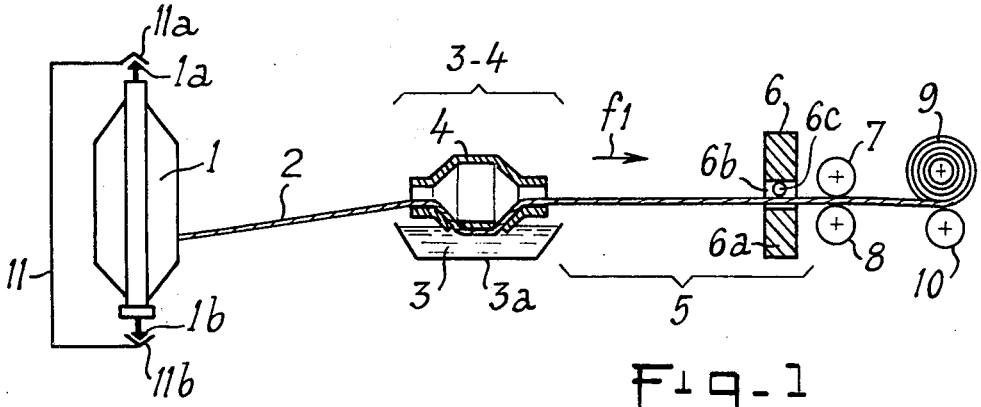
FIG. 1 diagrammatically illustrates a first embodiment of an installation according to the invention.

The installation illustrated in FIG. 1 comprises a supply bobbin 1 for the supply of textile strand or thread 2. The installation also comprises means 3, 4 for applying false twist to the textile strand or thread 2 and for applying wax to the strand or thread 2 in the false twisted state, namely, a wax bath 3 and a false twisting device 4, the false twisting device 4 being adapted and arranged to immerse the strand or thread 2 at least partially in the wax bath 3. The installation also comprises a cooling zone or chamber 5, a twisting member 6, a pair of tension rollers 7, 8, and a winding up bobbin 9 co-operating with a backing roller 10.

The bobbin 1 is a bobbin of the kind termed a spindle frame strand bobbin and has end tips 1*a*, 1*b*, located in suitable bearings 11*a*,11*b* on a support frame 11. This way of supporting the bobbin 1 permits easy unwinding of the strand 2 even at high speed.

The molten wax bath 3 is contained in a vessel 3*a* equipped with heating means and heat-insulating means (not shown) in order to be able to maintain the wax in its molten state and at a temperature only a few degrees higher than its melting point. Depending on the form, rotation and disposition with respect to the bath 3 of the false twisting device 4, and depending on the way in which the strand 2 is guided partially inside and partially outside the said device 4, lengths of strand are periodically immersed in the wax bath while the strand 2 continuously moves in the direction of the arrow $f_1$.

The false twisting device 4 has not only the function of periodically immersing lengths of strand in the molten wax bath 3 but also that of giving the part of strand upstream of the device 4 (considered in the direction of movement of the strand according to the arrow $f_1$) temporary false twisting which ensures, in the fibres in the part of the strand between the bobbin 1 and the device 4, temporary cohesion sufficient to permit, in turn, an advantageous increase in the speed of movement of the strand, without subjecting the bobbin to jerks upon unwinding the strand 2 which could otherwise be damaged.

Figure 2:
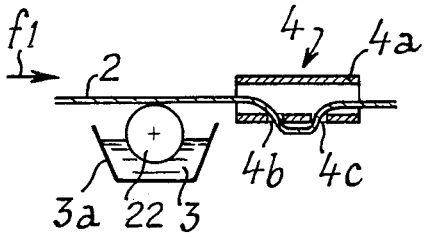
FIGS. 2 to 4 diagrammatically illustrate several embodiments of a means for applying wax and a false twist device.
Figure 3:
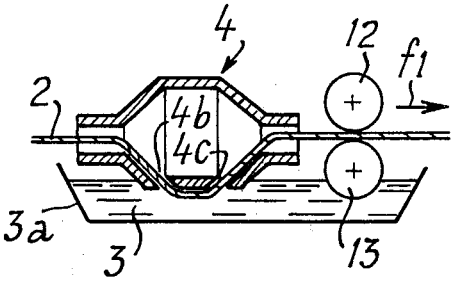
Figure 4:
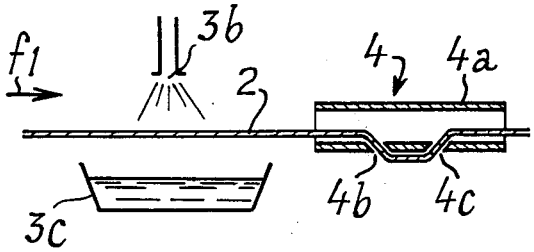

Several relatively simple false twisting devices 4, are shown in FIG. 2, FIG. 3 and FIG. 4, each comprising a cylindrical tube 4*a* which is equipped with means (not shown) for rotating it about its axis. Along a generatrix thereof, the cylindrical tube 4a has two bores 4b, 4c which place the interior of the tube in communication with the exterior. The bores 4b 4c are advantageously located in the junction zone between the first and the second thirds, and the second and the third thirds of the length of the tube 4a. However, the distance between the two bores is a function of the length of the lengths of strand in contact with the wax.

Figure 5:
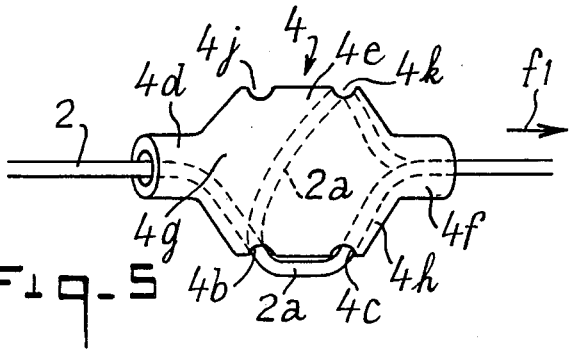
FIG. 5 shows a perspective view of a particular embodiment of the false twist device such as that used in the installation of FIG. 1.

For the purpose of driving the false twisting device 4 and particularly in order to keep it free from wax at the support and driving zones of the said device 4 when it has to immerse the strand in the wax bath 3, and finally in order to increase the length of the strand sections to be immersed in the said bath with no need for the length of the said device 4 to be increased, the device 4 advantageously comprises three tubular parts 4d 4e,4f, as shown in FIG. 5, the two end parts 4d, 4f having a diameter substantially smaller than that of the central part 4e and the central part being connected to the end parts 4d,4f by means of hollow frustoconical parts 4g, 4h. Bores 4b, 4c (equivalent to those of FIGS. 2,4 and 6) are preferably formed along the same generatrix of the central tubular part 4e and at the junction between the latter part and the neighbouring frustoconical parts 4g 4h. Two bores 4j,4k diametrically opposite to the bores 4b,4c are also provided so that the length of the section of strand 2a to be immersed in the wax bath 3 and located outside the device 4, can be increased by causing the strand 2 to diagonally pass through the bores 4b, 4k or 4j, 4c with no need for the length of the said device 4 (see FIG. 5) to be increased.

The cooling zone or chamber 5 is immediately downstream of the molten wax applying means 3,4. The length of the zone 5 can be very limited, and in most cases does not exceed 0.5 m. In the cooling zone or chamber, cooling may take place either in still air, or in forced gas circulation, particularly air circulation.

According to the embodiment illustrated in FIG. 1, forced cooling of the coated strand 2 may be carried out by means of the twisting member 6 which simply comprises a ring 6a having a central cylindrical recess 6b, into which there tangentially opens a bore 6c connected to an external compressed air source not shown. The air jet tangentially enters the recess 6b, through which the thread coated with wax moves coaxially, and has the functions of giving a false twist upstream, of applying to the coated strand 2 small fibres projecting from it, and of completely cooling of the wax on the said strand.

The pair of tension rollers 7,8 ensures unwinding of the strand 2 from the bobbin 1, and the winding up bobbin 9 together with its backing roller 10 stores the strand coated with solidified wax from the tension rollers 7,8.

FIGS. 2 to 4 illustrate various embodiments of the means for applying wax. According to FIG. 2, wax is applied on the strand by means of a rotating waxing roller 22 partially immersed in the molten wax 3. The strand 2 is in contact with the upper part of the waxing roller 22 and then moves to two end openings and to the bores 4b, 4c of the false twisting device 4.

Since the false twisting device 4 gives the strand portion upstream of the second bore 4c (in the direction of the arrow $f_1$) false twisting, the fibres in the strand 2 have sufficient cohesion while wax is applied thereto. It will be understood that the waxing roller 22 has an inner heating system, for example comprising electric resistances. In the embodiment illustrated in FIG. 2, the false twisting device 4 serves only to temporarily give the strand 2 false twisting. For this reason it is located outside and after the vessel 3a containing the wax bath 3.

FIG. 3 illustrates an embodiment of the means 3, 4 for applying molten wax similar to the means in the installation shown in FIG. 1 but having a further pair of pressure rollers 12, 13 through which the coated strand 2 passes after emerging from the false twisting device 4. The pressure rollers serve to squeeze any excess of wax adhering to the strand 2 after the latter has been immersed in the bath 3.

For a more efficient squeezing of the coated strand 2, it is advantageous to mount the pressure rollers 12, 13 immediately after the false twisting device 4 which also serves, as in the case of FIG. 1, to immerse the strand 2 in the wax bath 3. In order to be able in a simple manner to recover the wax squeezed out from the coated strand 2, it is suggested that the vessel 3a be extended beyond the pressure rollers 12, 13 so that the lower roller 13 is partially immersed in the bath 3.

According to the embodiment illustrated in FIG. 4, the means for applying molten wax substantially comprises an atomizing orifice 3b connected to a source of molten wax under pressure, not shown, and located above a vat 3c which serves to collect wax not retained by the strand 2. It is possible to simply suck the wax collected in the vat 3c by means of a pump and to deliver it to a reheating system before supplying it to the nozzle 3b. In the case of FIG. 4, the false twisting device 4 serves only to give the portion of strand upstream of its second bore 4c a false twist, and thus it must be located after the vat 3c and the atomizing nozzle 3b.

Since the speed of movement of the strand 2 is high, i.e. of at least of the order of 100 meters/min, the supply bobbin 1 is emptied very rapidly. In order to reduce dead time required for replacing an empty bobbin with a new one, it is possible to provide several bobbins 1 mounted on a rotatable frame, or even to use an installation such as that diagrammatically illustrated in FIG. 6.

Figure 6:
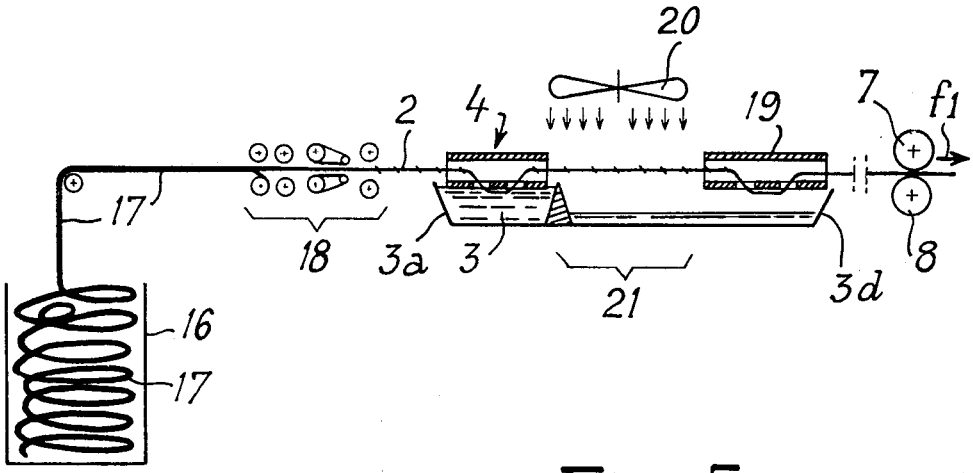
FIG. 6 diagrammatically illustrates a second embodiment of the installation according to the invention.

This installation comprises a storing can 16 in which there is stored a sliver 17 weighing for example about 20 kg, a succession of drawing rollers 18, means 3,4 for false twisting and for applying wax, a zone 21 at constant temperature including a squeezing device 19 followed by a cooling zone or chamber with a blower 20, tension rollers or cylinders 7,8, and a winding device 9,10 (as in FIG. 1) not shown in FIG. 6.

Since use is made, in this embodiment of the installation, of a fibre sliver 17 stored in a can 16 of large volume, and since a drawing unit is employed to draw the said sliver to a desired extent so as to obtain, at the outlet of the assembly 18, a strand or thread 2, all difficulties experienced in starting and in adjusting the speed are eliminated because the strand 2 emerges from the drawing assembly 18 at the movement speed at which it passes through the subsequent means and devices in the installation. The means 3, 4 for applying wax used in the installation illustrated in FIG. 6 are similar to those described with reference to FIG. 1. In the present case, immediately after the vessel 3a containing the wax bath 3 there is provided a collecting vat 3d which extends from the end of the cooling zone 5 to the end thereof downstream of the squeezing device 19 comprising a false twisting device identical or similar to any of those illustrated in FIGS. 1 to 5.

As already mentioned above, the false twisting devices give the portion of strand before them false twist. Thus the device 4 gives the portion of strand extending from the outlet of the drawing assembly 18 to the device 4 a false twist, so that the fibres in this portion have good cohesion with respect to each other, and the device 19 gives the portion of coated strand extending from the device 4 to the device 19, i.e. that disposed in the zone 21 at uniform temperature, false twist which serves, in this case, to promote cohesion among fibres and above all to squeeze the excess of wax out of the coated strand 2. In the zone 21 at uniform temperature it is possible to dispose, above the strand 2, the blower 20 to blow hot air onto the coated strand 2.

The speed of rotation of the false twisting devices 4 and 19 may vary within wide limits, for example so that the strand 2 is twisted at a speed in the range of 10 to 200 revolutions/min. Of course false twisting disappears automatically at the outlet of the false twisting device so that the strand coated with wax practically has no twist.

Figure 7:
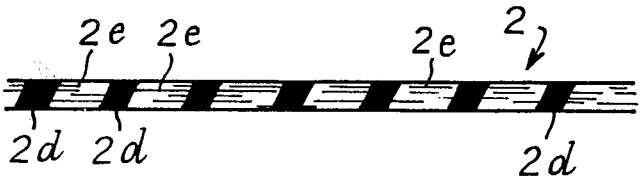
FIG. 7 shows a length of textile thread obtained by carrying out the method according to the invention.

The strand 2 may be coated with wax throughout its length and on all its surfaces. Strands fully coated are obtained when use is made of the means for applying wax illustrated in FIGS. 2 and 4. On the other hand, as diagrammatically shown in FIG. 7, one can obtain strands 2 having lengths **2*d* coated with wax alternated with lengths 2*e* free from wax when use is made of the application means 3,4 illustrated in FIGS. 1, 3 and 6. The length of the lengths 2*d* coated with wax is a function of the distance between the two bores 4*b*, 4*c* or 4*b*, 4*k* through which the strand 2 passes, of the speed of rotation of the false twisting device 4, and of the speed of movement of the strand 2. It will be understood that the distance between the two lengths 2*d* of strand coated with wax must be shorter than the average length of the fibres forming the said strand. In some cases it is advantageous to make the length of the lengths 2*d* of strand coated with wax as short as possible without decreasing the tensile strength of the said strand 2**. The strand thus formed has great flexibility and is well suited to be bent or folded with a small bending radius. Moreover, such a strand ensures easier dissolution of the wax once the strand has been incorporated in a knitted or weaved fabric.

Of course in order to keep the wax bath 3 and the recovered wax in a molten state, any kind of suitable heating means may be used, in particular hot-air heating or infrared radiation heating.

The term wax does not include exclusively waxes such as those defined in chemistry but any wax-like product, i.e. with no water, capable of melting at relatively low temperatures higher than the ambient temperature. Such waxes must be easy to apply and have, in the molten state, relatively low viscosity, preferably lower than 100 centipoises, and have sufficient adhesive power for textile materials.

Since one is dealing with primary products, it is possible easily to reduce the viscosity by increasing the temperature. It is possible to evaluate the adhesive power by the open/closed pliers strengths ratio of frame strand according to the well known method suggested some time ago (Bull.Soc.Chim. de France, special No. 1970, rapport on Discussion about adhesion by Mulhouse, 1969). This rapport takes as a maximum value 1; tests have proved that a value of 0.5 may be sufficient in numerous cases; if such a value exceeds 0.7 the product is particularly suitable.

We claim:

1. An installation for treating a textile strand such as sliver or roving with no twist, said installation comprising strand storing means able to deliver a textile strand stored in said strand storing means, means located downstream from said strand storing means for applying molten wax onto said delivered strand, a first false twisting device for imparting a false twist to said strand and a second false twisting device located downstream from said first false twisting device, said second false twisting device being arranged to give said strand a false twist which is propagated up to said first false twisting device, cooling means for cooling said strand having molten wax applied thereon, a pair of tension rollers for exerting a tension on the strand and winding up means located downstream from said pair of tension rollers for winding up the treated strand.

2. An installation according to claim 1, wherein said strand storing means comprises a strand storing bobbin.

3. An installation according to claim 1, wherein said strand storing means comprises a strand storing can.

4. An installation according to claim 3, wherein there is provided a drafting unit between said strand storing can and said means for applying molten wax.

5. An installation according to claim 1, wherein said first false twisting device is included in said means for applying molten wax, said means for applying molten wax comprising a wax bath, and said first false twisting device is arranged to be immersed in said wax bath over a part of its periphery carrying a length of textile strand.

6. An installation according to claim 1 wherein there is provided after said means for applying molten wax, a wax squeezing device.

7. An installation according to claim 1 wherein there is provided a constant temperature zone between said first false twisting device and said second false twisting device.

8. An installation according to claim 7 wherein there is provided a blower at said constant temperature zone above said strand.

9. An installation according to claim 1, wherein said cooling means comprises a member having a recess through which said strand passes, an orifice opening onto said recess substantially tangentially for supplying pressurized air into said strand passing through said recess.

10. A method of treating a textile strand such as a roving or a sliver with no twist in order to render it able to undergo knitting or weaving, said method comprising, in order, the steps of:

subjecting temporarily said strand to false twist; coating said strand in its false twisted state at least at regular intervals therealong with a wax in molten state by intermittent immersion in a wax bath of lengths of strand so that lengths of immersed strand alternate with lengths of strand not immersed in said wax bath, said coating step and said step of subjecting temporarily said strand to false twist being combined with one another;

cooling said coated strand while maintaining it in a false twisted state; and winding said strand on bobbin means.

* * * * *